United States Patent [19]

Yoshida

[11] Patent Number: 4,706,538

[45] Date of Patent: Nov. 17, 1987

[54] ELECTRONIC MUSICAL INSTRUMENT WITH AUTOMATIC MUSICAL ACCOMPANIMENT PLAYING SYSTEM

[75] Inventor: Kiyoshi Yoshida, Hamamatsu, Japan

[73] Assignee: Nippon Gakki Seizo Kabushiki Kaisha, Shizuoka, Japan

[21] Appl. No.: 939,344

[22] Filed: Dec. 8, 1986

[30] Foreign Application Priority Data

Dec. 10, 1985 [JP] Japan ..... 60-275926

[51] Int. Cl.[4] ..... G10H 1/22; G10H 1/42

[52] U.S. Cl. ..... 84/1.03; 84/DIG. 2; 84/DIG. 12; 307/231; 340/365.5; 340/825.5

[58] Field of Search ..... 84/1.01, 1.03, DIG. 2, 84/DIG. 12; 307/231; 340/365.5, 825.5, 825.51

[56] References Cited

U.S. PATENT DOCUMENTS 4,351,214 9/1982 Suzuki et al. ..... 84/1.03

4,365,532 12/1982 Nakada et al. ..... 84/1.19

4,402,245 9/1983 Oya et al. ..... 84/DIG. 2

*Primary Examiner*—Stanley J. Witkowski

*Attorney, Agent, or Firm*—Spensley Horn Jubas & Lubitz

[57] ABSTRACT

An electronic musical instrument automatically plays a musical accompaniment utilizing a minimized number of tone signal generating channels. The electronic musical instrument has a plurality of tone signal generating channels each for generating a tone signal representative of a tone to be produced. Keys depressed on an associated keyboard are assigned to the tone signal generating channels to cause them to generate tone signals corresponding to the depressed keys. When an automatic accompaniment circuit is actuated, a predetermined number of ones of the plurality of tone signal generating channels are reserved for generation of tone signals of the accompaniment. The reservation is made such that those channels which are idle are selected at the highest priority, those channels to which the earliest released keys are assigned at the second highest priority, and those channels to which the earliest depressed keys are assigned at the third highest priority.

5 Claims, 14 Drawing Figures

ELECTRONIC MUSICAL INSTRUMENT WITH AUTOMATIC MUSICAL ACCOMPANIMENT PLAYING SYSTEM

BACKGROUND OF THE INVENTION

1. Field of the Invention

The present invention relates to an electronic musical instrument with an automatic musical accompaniment playing system for automatically playing musical accompaniment chords such as rhythmic chords and melodic chords (arpeggios).

2. Prior Art

There has been proposed an electronic musical instrument which includes an automatic musical accompaniment playing system for automatically playing musical accompaniment chords such as rhythmic chords and melodic chords (arpeggios) in accordance with chords determined by keys depressed on an associated keyboard. Each rhythmic chord is played by intermittently generating all constituent tones of the chord at timings determined by a selected rhythm, and each melodic chord is played by selectively generating one or more constituent tones of the chord in an order determined by a selected rhythm. Such conventional electronic musical instrument generally comprises, in addition to tone generating channels for generating principal tones, a plurality of tone generating channels for exclusive use by the automatic musical accompaniment system. Thus, the conventional electronic musical instrument has needed a relatively large number of tone generating channels. Moreover, the tone generating channels for the exclusive use operate only when the automatic musical accompaniment system is used and are all idle in other cases.

U.S. Pat. No. 4,365,532 issued on Dec. 18, 1982 and U.S. Pat. No. 4,450,745 issued on May 29, 1984 disclose an electronic musical instrument in which tone generating channels are selectively assigned to upper keyboard tones or manual performance tones and to lower keyboard tones or automatic performance tones. The assignment mode of the channels is changed according to the performance mode of the instrument. However, in this instrument, the tone generating channels to be assigned to lower keyboard tones or automatic performance tones are predetermined. For example, if there are ten tone generating channels, channels 1 to 5 are always assigned to the automatic performance tones when an automatic performance mode is selected. This change of assignment is made irrespective of the conditions of the channels 1 to 5. Therefore, generating tone or tones may be cut if the automatic performance mode is selected when any of the channels 1 to 5 is being used for tone generation.

SUMMARY OF THE INVENTION

It is therefore an object of the present invention to provide an electronic musical instrument with an automatic musical accompaniment playing system which can operate with a minimized number of tone generating channels.

It is another object of the invention to provide an electronic musical instrument in which tone generating channels of a limited number are effectively used in different performance modes of the instrument without affecting the tones under generation.

According to an aspect of the present invention, there is provided an electronic musical instrument having a keyboard and an automatic musical accompaniment playing system for automatically playing a musical accompaniment, the electronic musical instrument comprising keyboard circuit means responsive to each depression of key on the keyboard for outputting a key code representative of the depressed key; tone generating means having a plurality of tone signal generating channels each for generating a tone signal representative of a tone to be generated; assigning means for assigning the key codes from the keyboard circuit means to the plurality of tone signal generating channels, each of the tone signal generating channels generating the tone signal corresponding to the key whose key code is assigned thereto; playing mode selection means for selecting one of a plurality of playing modes of the electronic musical instrument which include an automatic playing mode wherein the automatic musical accompaniment system operates; and channel reserving means for reserving a predetermined number of channels among the plurality of tone signal generating channels for use by the automatic musical accompaniment system when the automatic playing mode is selected by the playing mode selection means, the channel reserving means selecting the channels of the predetermined number from among the plurality of channels according to a predetermined priority order which is based on the conditions of tone generation of the respective channels.

DESCRIPTION OF THE PREFERRED EMBODIMENTS OF THE INVENTION

Figure 1:
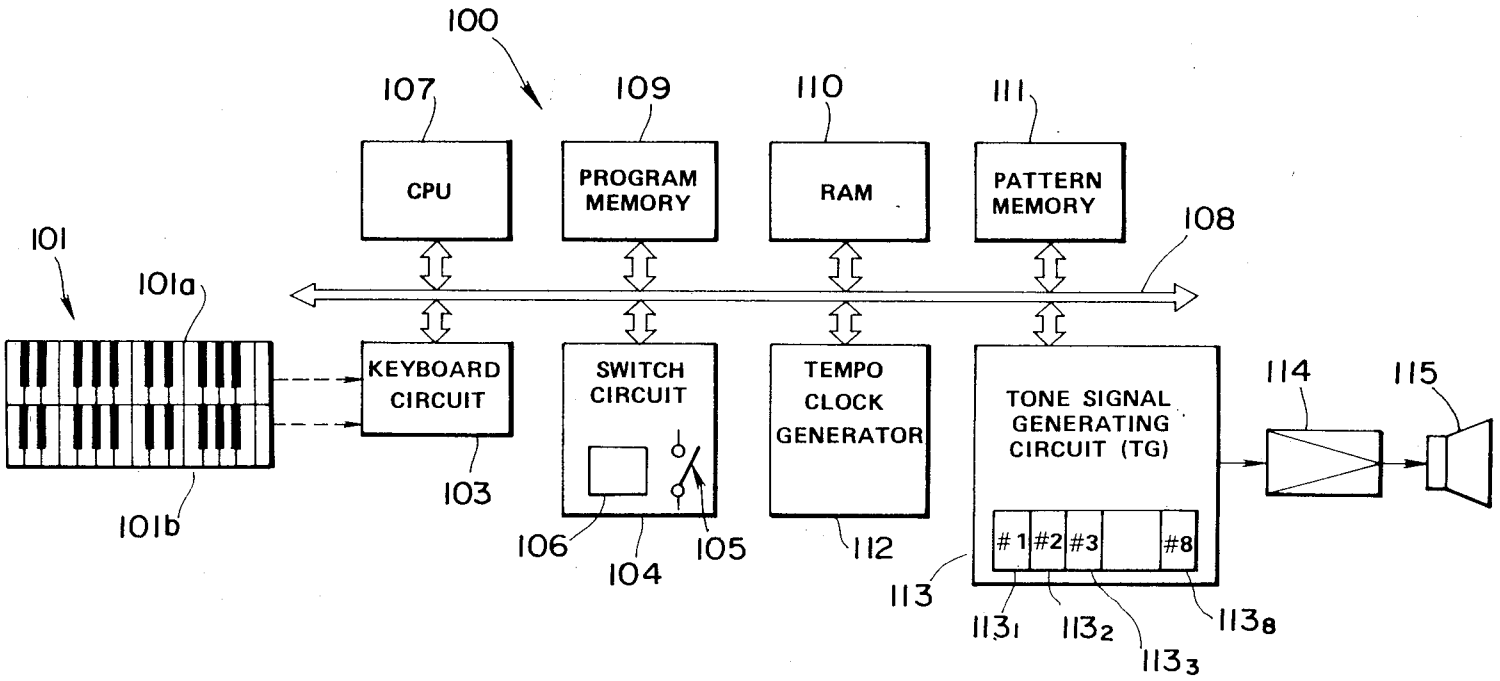
FIG. 1 is a block diagram of an electronic musical instrument 100 provided in accordance with the present invention.

Referring now to FIG. 1, there is shown an electronic musical instrument 100 provided in accordance with the present invention. The electronic musical instrument 100 comprises a keyboard 101 having an upper keyboard (melody keyboard) 101*a* and a lower keyboard (harmony keyboard) 101*b*, both of which are electrically connected to a keyboard circuit 103. The keyboard circuit 103 detects each depression of key on the upper and lower keyboards 101*a* and 101*b* and produces key information (or a key code) representative of each depressed key. Shown at 104 is a switch circuit which includes a rhythm start/stop switch (rhythm switch) 105 for controlling start and stop of operation of an auto rhythm system provided in this instrument 100, a rhythm selection switch 106 for selecting a desired one of a plurality of kinds of rhythms, and other necessary switches. The rhythm switch 105 and the rhythm selection switch 106 are provided on a console (not shown) of this electronic musical instrument 100.

The keyboard circuit 103 and the switch circuit 104 are connected to a central processing unit (CPU) 107 through a bidirectional signal bus 108. The CPU 107 controls most of portions of the electronic musical instrument 100 in accordance with programs stored in a program memory 109 composed of a ROM. The CPU 107 is also connected through the signal bus 108 to a RAM 110 providing a working area for storing various temporary data, a pattern memory 111 storing various chord pattern data, a tempo clock generator 112 for generating a tempo clock signal, and a tone signal generating circuit (TG) 113. The tone signal generating circuit 113 comprises eight sets (#1 to #8) of tone signal generating channels $\mathbf{113}_1$ to $\mathbf{113}_8$ each for generating a tone signal.

The CPU 107 reads the key codes outputted from the keyboard circuit 103 and data representative of states of the switches from the switch circuit 104; performs data processing to produce musical information such as data representative of beginning of generation of a tone, data representative of end of generation of a tone, data representative of a pitch of a tone, and data representative of a tone color of a tone; and outputs the musical information to the tone signal generating circuit 113.

The RAM 110 provides therein various flags, registers and buffers described hereunder:

Rhythm Run Flag RHY

Figure 2:
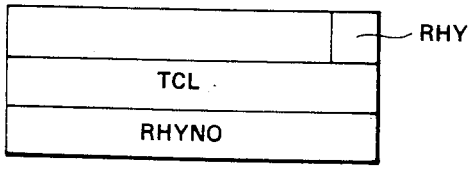
FIG. 2 is an illustration showing a rhythm rum flag RHY, a tempo counter TCL and a rhythm number register RHYNO provided in the RAM 110 of FIG. 1.

The rhythm run flag RHY shown in FIG. 2 is set to "1" by the CPU 107 when the rhythm switch 105 is closed to run the auto rhythm system, and is reset to "0" when the switch 105 is opened to stop the auto rhythm system.

Tempo Counter TCL

This tempo counter TCL (FIG. 2) counts pulses of the tempo clock signal outputted from the tempo clock generator 112 within the range of from "0" to "63". The contents of this counter TCL represent the current time position within a rhythm pattern, for example, of two measures.

Rhythm Number Register RHYNO

This register RHYNO (FIG. 2) stores, under the control of the CPU 107, the number (or the kind) of the rhythm selected through the rhythm selection switch 106.

Assigned Channel Registers $ARPASS_i$ ("i"="1" to "4")

Figure 3:
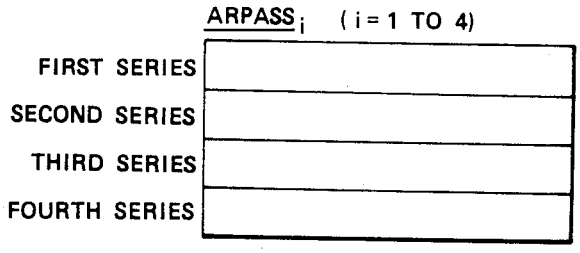
FIG. 3 is an illustration showing assigned channel registers $ARPASS_i$ provided in the RAM 110 of FIG. 1.

These assigned channel registers $ARPASS_i$ respectively store the numbers of those tone signal generating channels to which tones of an accompaniment chord to be produced are assigned. FIG. 3 shows the format of the assigned channel registers $ARPASS_i$. The maximum number of tones allowed to be generated for an accompaniment chord is four in this electronic musical instrument 100, so that four registers $ARPASS_1$ to $ARPASS_4$ are provided.

Priority Reqisters $PRIOREG_j$ ("j"="1" to "8")

Figure 4:
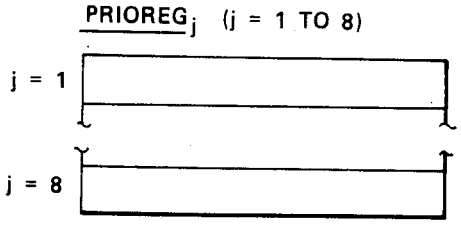
FIG. 4 is priority registers $PRIOREG_j$ provided in the RAM 110 of FIG. 1.

These priority registers $PRIOREG_1$ to $PRIOREG_8$, of which format is shown in FIG. 4, correspond respectively to the #1 to #8 tone signal generating channels $\mathbf{113}_1$ to $\mathbf{113}_8$The priority register $PRIOREG_j$ containing data equal to "0" indicates that a tone of an accompaniment chord to be produced is assigned to the corresponding tone signal generating channel $\mathbf{113}_j$. On the other hand, the priority registers containing data other than "0" determine to which tone signal generating channel a tone of an accompaniment chord to be produced should be assigned. In other words, each of the priority registers containing data other than "0" is used as a counter of which contents determine a key-assigning priority. In this case, the most significant bit (MSB) of each of the priority registers containing data other than "0" functions as a flag which indicates whether the corresponding tone generating channel is being used (or busy). More specifically, the MSB of the priority register $PRIOREG_j$ is "0" when the key assigned to the corresponding tone signal generating channel $\mathbf{113}_j$ is in a depressed state (assuming that the corresponding tone signal generating channel $\mathbf{113}_j$ is not assigned a tone of an accompaniment chord). When the key assigned to the tone signal generating channel $\mathbf{113}_j$ is in a released state or when the channel $\mathbf{113}_j$ is idle, the MSB of the corresponding priority register $PRIOREG_j$ is "1". The lower seven bits of each of the priority registers constitute a counter which counts up any manipulations (or events) of the keys assigned to those channels other than the corresponding tone signal generating channel. The number of key events in each counter represents the time elapsed after the depression or release of the key assigned to the corresponding tone signal generating channel.

Key Code Buffer KEYCOD

The buffer KEYCOD stores each key code, which is fed from the keyboard circuit 103 in response to a manipulation of key (or a key event on the keyboard 101), and one-bit data representative of the kind of the key event, as shown in 5. More specifically, the MSB of the buffer KEYCOD stores a key ON/OFF bit representative of whether the event was a depression (or ON) of key or a release (or OFF) of key. The remaining seven bits of the buffer KEYCOD store the key code of the manipulated key. In this case, the key code contains at its higher-order three bits an octave code OCT representative of the key zone to which the key represented by the key code belongs, and contains at its lower-order four bits a note code NOTE representative of a note name of the key represented by the key code. The note code takes a value of from "0" to "11" which correspond respectively to note names C, C#, . . . , A# and B.

Key Buffer $KEYBUF_j$ ("j"="1" to "8")

Figure 6:
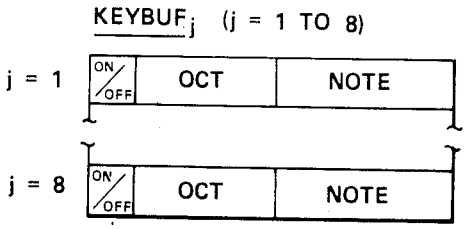
FIG. 6 is an illustration showing key buffers $KEYBUF_j$ provided in the RAM 110 of FIG. 1.

The key buffers $KEYBUF_j$ store one or more key codes of those keys which are in the depressed state, each buffer storing one key code. Each of the key codes is stored in the buffers $KEYBUF_j$ in the same format as that stored in the key code buffer KEYCOD, as shown in FIG. 6. The number of the buffers $KEYBUF_j$ is eight which is equal to the number of the tone signal generating channels of the tone signal generating circuit 113.

Temporary Buffers OFFCH and EVCH

The temporary buffer OFFCH (FIG. 7) stores the number of the tone signal generating channel with respect to which a key-off processing should be performed by the CPU 107. The temporary buffer EVCH (FIG. 7) stores the number of the tone signal generating channel with respect to which a processing relating to a key event should be performed.

Temporary Buffers MAXCNT and MAXCH

The buffer MAXCNT (FIG. 7) stores the largest one of the count values contained in the eight priority registers $PRIOREG_1$ to $PRIOREG_8$, and the buffer MAXCH stores the number of the tone signal generating channel which corresponds to that priority register containing the largest count value.

Figure 8:
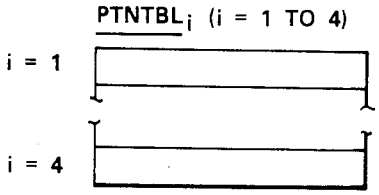
FIG. 8 is an illustration showing rhythm pattern tables $PTNTBL_i$ provided in the pattern memory 111 of FIG. 1.

Referring again to FIG. 1, the pattern memory 111 stores therein pattern tables $PTNTBL_i$ ("i" ="1" to "4"). As shown in FIG. 8, each of the pattern tables $PTNTBL_i$ stores a group of chord pattern data for the automatic accompaniment which are equal in number to the product of the number of the rhythm patterns available and that of the chord types. Four series of accompaniment chords are available in this electronic musical instrument 100, so that the number of the pattern tables $PTNTBL_i$ is four.

The tempo clock generator 112 comprises a fixed frequency oscillator and a frequency divider of a variable division-rate type (not shown) for dividing the frequency of the output of the oscillator to produce the tempo clock whose frequency is, for example, one-eight of one beat (or a quarter note). The period of the tempo clock signal can be changed by manipulating a knob or switches (not shown) provided on the instrument console and connected to the frequency divider.

The tone signal generating channels $113_1$ to $113_8$ generate, in accordance with the musical information fed by the CPU 107, musical tone signals representative of melody tones, chord tones and base tones. The musical tone signals thus generated are amplified by an amplifier 114 and converted into musical sound by a loudspeaker 115.

The operation of the electronic musical instrument 100 will now be described with reference to flow charts shown in FIGS. 9 to 14.

Main Processing

Figure 9:
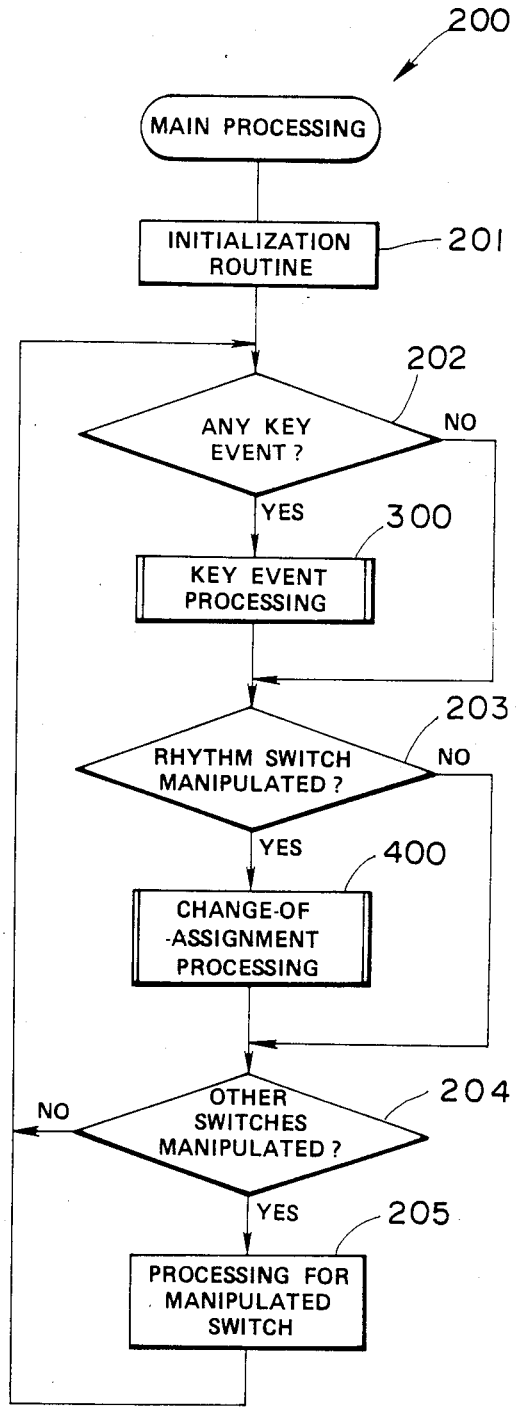
FIG. 9 is a flow chart of a main processing 200 executed by the CPU 107 of FIG. 1.

When power is supplied to this electronic musical instrument 100, the CPU 107 begins to carry out a main processing 200 shown in FIG. 9 in accordance with the control programs stored in the program memory 109. At step 210 of the main processing 200, the CPU 107 executes an initialization routine of the control programs to clear the flag RHY, the tempo counter TCL, the buffers KEYCOD and $KEYBUF_1$ to $KEYBUF_8$ and the registers RHYNO and $ARPASS_1$ $ARPASS_4$. The CPU 107 also stores "256" (or "11111111") into each of the priority registers $PRIOREG_1$ to $PRIOREG_8$ and initializes other circuit portions of this electronic musical instrument 100. Then, the CPU 107 begins to perform the remaining portion of the main processing 200 which includes steps 202 to 205, 300 and 400.

Figure 10:
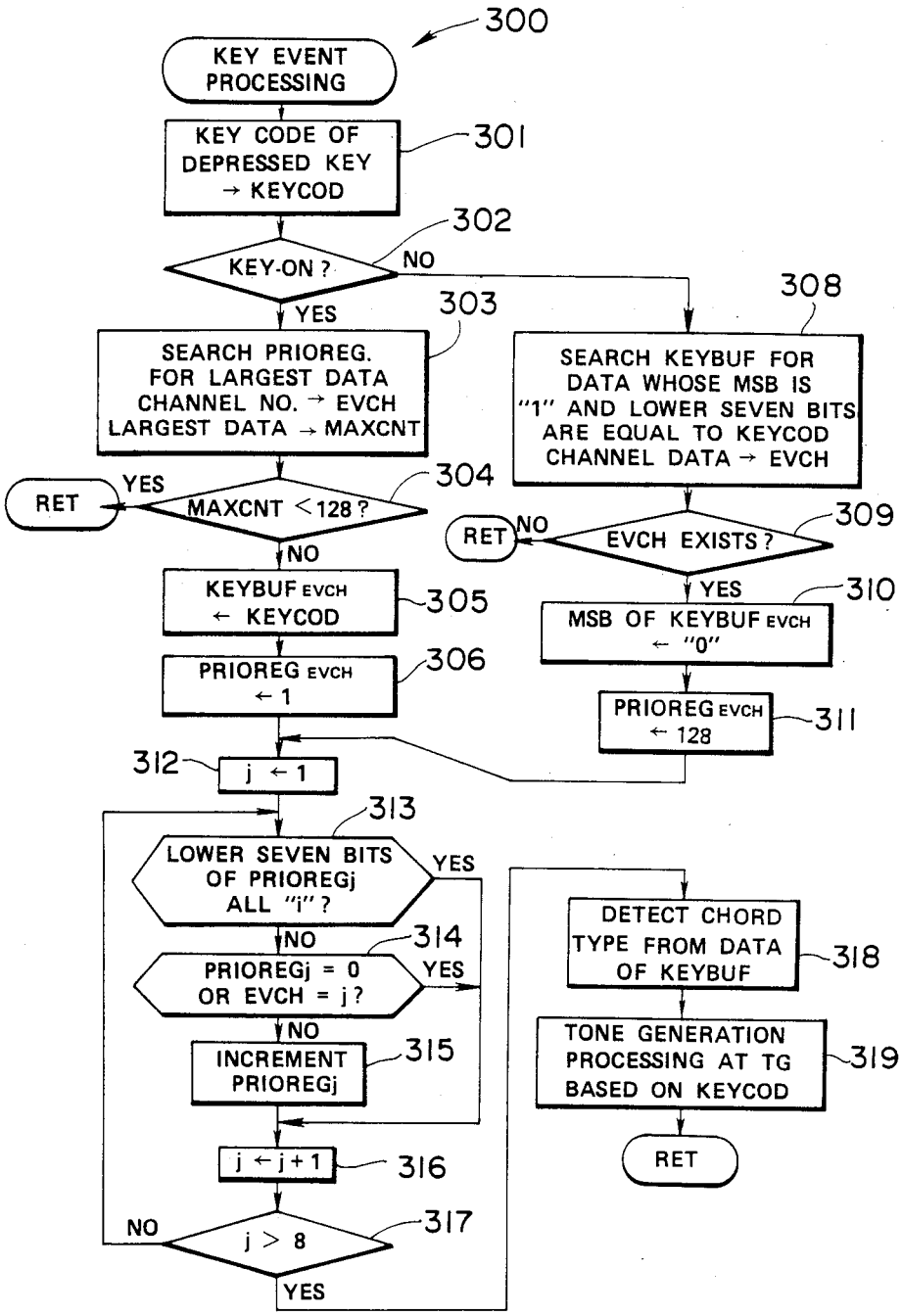
FIG. 10 is a flow chart of a key event processing executed by the CPU 107 of FIG. 1.
Figure 11:
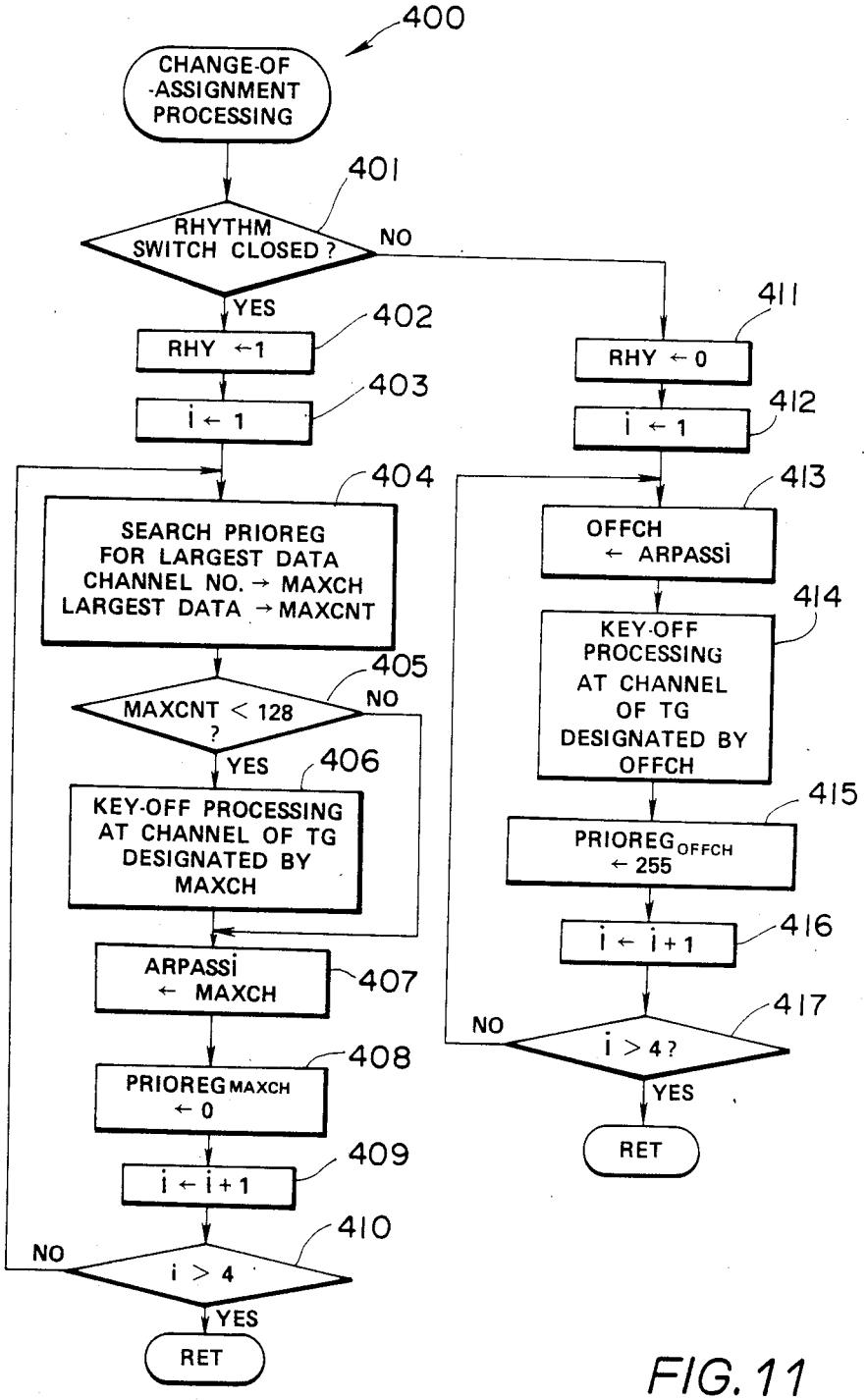
FIG. 11 is a flow chart of a change-of-assignment processing executed by the CPU 107 of FIG. 1.
Figure 12:
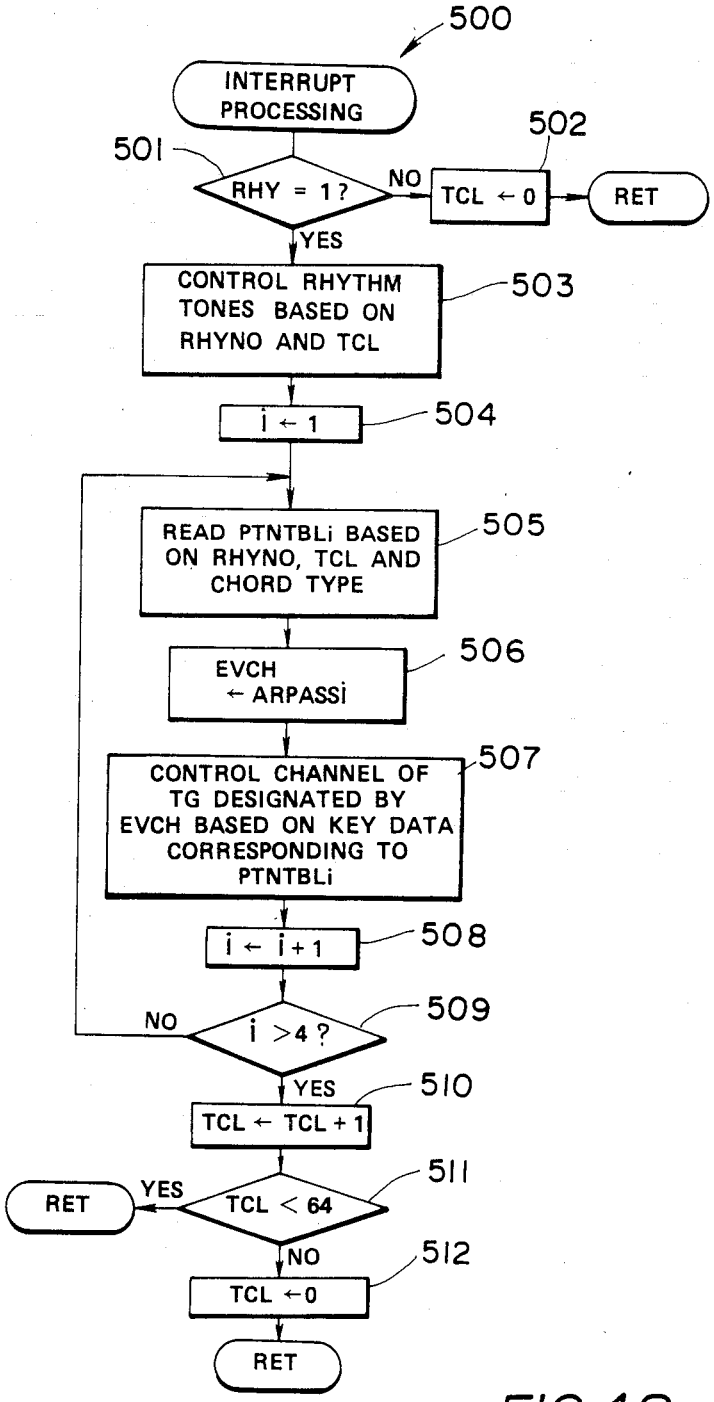
FIG. 12 is is a flow chart of a tempo interrupt processing executed by the CPU 107 of FIG. 1.

At the step 202, it is determined whether the state of any one of the keys of the keyboard 101 has been changed, that is, whether there has occurred any key event on the keyboard 101. If the determination result is "Yes", the processing proceeds to the step 300, at which a key event processing shown in FIG. 10 is carried out, and thence to the step 203. On the other hand, if the determination result is "NO", the processing proceeds directly to the step 203. At the step 203, it is determined whether the rhythm switch 105 has been manipulated. If the determination result is "YES", the processing proceeds to the step 400, at which a change-of-assignment processing shown in FIG. 11 is carried out, and thence to the step 204. On the other hand, if the determination result is "NO", the processing proceeds directly to the step 204. The rhythm switch 105 is a switch for causing the auto rhythm system to operate or stop, that is, a switch for changing a playing mode. The electronic musical instrument 100 operates in one of two playing modes, namely a normal playing mode wherein an accompaniment chord is not produced, and an automatic playing mode wherein an accompaniment chord is produced. At the step 204, it is determined whether the state of any one of the rhythm selection switch 106 and other switches on the instrument console has been manipulated. If the determination result is "YES", the processing proceeds to the step 205 to carry out a processing for the manipulated switch, and thence returns to the step 202. On the other hand, if the determination result is "NO", then the processing returns directly to the step 202. The foregoing is what is performed in the main processing 200.

The keyboard 101 includes the upper or melody keyboard 101*a* and the lower or harmony keyboard 101*b*, as described earlier. However, the following description will be given only as to the operation of the instrument 100 performed in response to key manipulations on the harmony keyboard 101*b*.

2. Key Event Processing

The key event processing performed at the step 300 will now be more fully described with reference to the flow chart of FIG. 10.

Figure 5:
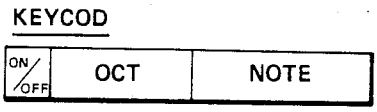
FIG. 5 is an illustration showing a key code buffer KEYCOD provided in the RAM 110 of FIG. 1.
Figure 7:
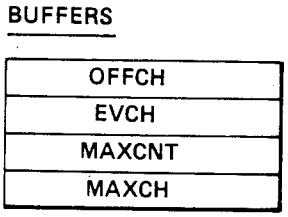
FIG. 7 is an illustration showing buffers OFFCH, EVCH, MAXCNT and MAXCH provided in the RAM 110 of FIG. 1.

At step 301, the CPU 107 reads the key code representative of the manipulated key from the keyboard circuit 103 and stores the read key code into the key code buffer KEYCOD (FIG. 5). At the next step 302, it is determined whether the manipulation of key was a depression of key or a release of key. If it is determined that the manipulation of key was a depression of key, the CPU 107 searches, at step 303, the eight priority registers $PRIOREG_1$ to $PRIOREG_8$ for the largest one of the eight data respectively contained therein, and stores the largest data into the buffer MAXCNT (FIG. 7). The CPU 107 also stores the number j of the priority register $PRIOREG_j$ which contains the largest data into the buffer EVCH. At the next step 304, the CPU 107 compares the largest data contained in the buffer MAXCNT with "128". If the data contained in the buffer MAXCNT is smaller than "128", all the MSBs of the data contained in the priority registers $PRIOREG_1$ to $PRIOREG_8$ are "0". In this case, all the tone signal generating channels $113_1$ to $113_8$ are assigned to generate tones corresponding to the depressed keys or to generate tones of the accompaniment chord, so that all the tone signal generating channels are in the operating condition. And therefore, the newly depressed key whose key code was stored into the key code buffer KEYCOD at the step 301 is ignored, and the processing returns to the step 203 of the main processing 200. On the other hand, if the largest data contained in the buffer MAXCNT is greater than or equal to "128", the CPU 107 stores, at step 305, the key code contained in the buffer KEYCOD into one of the key buffers $KEYBUF_1$ to $KEYBUF_8$ which is designated by the channel number in the buffer EVCH. Thus, the newly depressed key is assigned to one of the idle tone signal generating channels or to the tone signal generating channel to which the earliest released key is assigned. At step 306, the CPU 107 stores "1" (or "00000001") into one of the priority registers $PRIOREG_1$ to $PRIOREG_8$ which corresponds to the newly assigned tone signal generating channel (or to the channel number in the buffer EVCH). The reason why data equal to "1" is stored in the above priority register is that "0" is used to identify those tone signal generating channels to which keys for an accompaniment chord are assigned.

On the other hand, if it is determined at the step 302 that the manipulation of key was a release of key (or a keyoff), the processing proceeds to step 308. At this step 308, the CPU 107 searches the key buffers $KEYBUF_1$ to $KEYBUF_8$ to determine if any one of them includes "1" at the MSB (on-off bit) and data equal to the lower seven bits of the key code buffer KEYCOD at the lower seven bits. If such key buffer KEYBUF is found, the number of the key buffer KEYBUF thus found is stored into the temporary buffer EVCH. Thus, the key, which was assigned to one of the tone signal generating channels $113_1$ to $113_8$ when depressed, is detected, and the number of the channel assigned the key is stored into the buffer EVCH. At the next step 309, it is determined if there is any channel number stored in the buffer EVCH. If it is determined that there is no channel number stored in the buffer EVCH, the processing returns to the main processing 200. This is because the released key is that key which was ignored when depressed, due to no presence of tone signal generating channel to which the depressed key could be assigned. On the other hand, if it is determined that there is a channel number stored in the buffer EVCH, the CPU 107 initializes the key buffer KEYBUF, designated by the channel number contained in the buffer EVCH, by changing the on-off bit (MSB) thereof to "0" at step 310. The CPU 107 also stores "128" (or "10000000") as an initial value into the priority register PRIOREG designated by the channel number in the buffer EVCH at the next step 311. As a result, the MSB of the designated priority register PRIOREG is rendered "1". This priority register PRIOREG is thereafter used as a counter for measuring time elapsed after the release of the corresponding key. Then, the processing proceeds to step 312.

The step 312 and steps 313 to 317 are provided for incrementing the contents of each of the eight priority registers $PRIOREG_1$ to $PRIOREG_8$ by one. More specifically, the CPU 107 renders the "j" to "1" at the step 312, and then determines whether the lower-order seven bits of the register $PRIOREG_j$ are all "1" at the next step 313. If the contents of the lower-order seven bits of the register $PRIOREG_j$ are all "1", the processing proceeds to the step 316 to maintain the contents as they are. On the other hand, if the lower-order seven bits includes a bit or bits in the state of "0", the CPU 107 further determines at the step 314 whether the contents of the register $PRIOREG_j$ are "0" or whether the "j" is equal in value to the contents of the buffer EVCH. If it is determined that the contents of the register $PRIOREG_j$ is "0", the tone signal generating channel $113_j$ is assigned as a channel for an accompaniment chord, so that the contents of the register $PRIOREG_j$ is not incremented. The buffer EVCH contains the channel number loaded at the step 303 or 308, and therefore in the case where the "j" is equal to the contents of the buffer EVCH, the register $PRIOREG_j$ contains the data newly loaded at the step 306 or 311. In this case, the increment of the contents of the register $PRIOREG_j$ is not performed. If it is determined at the step 314 that the contents of the register $PRIOREG_j$ are not equal to "0" and that the contents of the buffer EVCH are not equal to "j", the contents of the priority register $PRIOREG_j$ are incremented at the next step 315. Then, the "j" is incremented by one at the step 316, and it is determined at the next step 317 whether the "j" is greater than "8". If the "j" is smaller than or equal to "8", the processing returns to the step 313 to perform the same processing for the next priority register $PRIOREG_j$. On the other hand, if the "j" is greater than "8", the processing proceeds to step 318.

At the step 318, the CPU 107 determines the type of the accompaniment chord based on the data contained in the eight key buffers $KEYBUF_1$ to $KEYBUF_8$. The CPU 107 then carries out a tone generating processing or a tone-generation stopping processing for the tone signal generating circuit 113 in accordance with the contents of the buffer KEYCOD. Then, the processing returns to the step 203 of the main processing 200.

3. Change-of-Assignment Processing

When the change-of-assignment processing 400 is started, it is determined at step 401 of FIG. 11 whether the rhythm switch 105 was closed or opened. If it is determined that the rhythm switch 105 was opened, then the processing proceeds to step 411. On the other hand, if it is determined that the rhythm switch 105 was closed, the flag RHY is set to "1" at step 402, and the following processing is carried out at steps 403 to 410 to reserve four of the tone signal generating channels $113_1$ to $113_8$ for producing an accompaniment chord.

At the step 403, the "1" is set to "1". Then, the CPU 107 searches, at the next step 404, the eight priority registers $PRIOREG_1$ to $PRIOREG_8$ for the one which contains the largest data, and stores the largest data into the buffer MAXCNT. The CPU 107 also stores, into the buffer MAXCH, the number of the tone signal generating channel which corresponds to the priority register containing the largest data. At the next step 405, the CPU 107 compares the largest data contained in the buffer MAXCNT with "128" (or "10000000"). If the data in the MAXCNT is smaller than "128", it is determined that the key assigned to the tone signal generating channel which corresponds to the priority register containing the largest data is in the depressed state, so that a key-off processing is performed at step 406 with respect to the tone signal generating channel of the tone signal generating circuit 113 designated by the contents of the buffer MAXCH. Thus, if there is no tone signal generating channel, the key assigned to which is in the released state, the tone signal generating channel corresponding to the earliest depressed key is forcibly released from the assignment of the earliest depressed key. Then, the processing proceeds to the next step 407. On the other hand, if the largest data contained in the buffer MAXCNT is greater than or equal to "128", the processing proceeds from the step 405 directly to the step 407. At the step 407, the channel number contained in the buffer MAXCH is stored into the assigned channel register $ARPASS_i$ so that the tone signal generating channel designated by the channel number is reserved for the accompaniment chord. At the next step 408, "0" is stored into the priority register PRIOREG designated by the channel number contained in the buffer MAXCH thereby to indicate that the tone signal generating channel designated by the channel number is for the accompaniment chord. The "i" is then incremented by one at the step 409. At the next step 410, the "i" is compared with "4" which corresponds to the maximum number of tone signal generating channels for an accompaniment chord. If the "i" is smaller than or equal to "4", the processing returns to the step 404 to reserve other tone signal generating channels for the accompaniment chord. On the other hand, if the "i" is greater than "4", this change-of-assignment processing is terminated, and the processing is returned to the main processing 200.

If it is determined at the step 401 that the rhythm switch 105 was opened, the flag RHY is reset to "0" at step 411. Then, the following processing is performed at steps 412 to 417 to release the four channels from the reservation for the accompaniment chord.

At the step 412, the "i" is set to "1". Then, the channel number contained in the assigned channel register $ARPASS_i$ and indicative of one of the four tone signal generating channels reserved for the accompaniment chord is stored into the temporary buffer OFFCH at the step 413. At the next step 414, a key-off processing is performed with respect to the tone signal generating channel of the tone signal generating circuit 113 designated by the channel number in the buffer OFFCH. At the step 415, "255"(or "11111111") is stored into the priority register PRIOREG designated by the channel number contained in the buffer OFFCH. Thus, the priority register PRIOREG is loaded with data indicating that the corresponding tone signal generating channel is idle. The "i" is incremented by one at the step 416, and is then compared with "4" at the next step 417. If the "i" is smaller than or equal to "4", the processing returns to the step 413 to release the next one of the four channels from the reservation for the accompaniment chord. If the "i" is greater than "4", all of the four tone signal generating channels have been released from the reservation for the accompaniment chord, so that the processing returns to the main processing 200 of FIG. 9.

4. Tempo Interrupt Processing

As described earlier, the CPU 107 of the electronic musical instrument 100 shown in FIG. 1 receives the tempo clock generated by the tempo clock generator 112 as an interrupt signal, and performs an interrupt processing 500 in response to each of the interrupt signals. The CPU 107 first determines at step 501 of FIG. 12, whether the rhythm run flag RHY is "1". If the determination result is "NO", the auto rhythm system is not running, so that the CPU 107 clears the tempo counter TCL at step 502, resets the interruption, and returns its control to the main routine 200.

On the other hand, if the rhythm run flag RHY is in the "1" state, that is to say, if an accompaniment is being played with the auto rhythm system being running, the processing proceeds to step 503. At this step 503, a processing for controlling rhythm tones is carried out based on the contents of the tempo counter TCL and the rhythm number register RHYNO. The generation of tones of the accompaniment chord is achieved by the steps 504 to 509. More specifically, the "i" is first set to "1" at the step 504. Then, the CPU 107 reads, from the table $PTNTBL_i$, rhythm pattern data determined in accordance with the contents of the register RHYNO and the tempo counter TCL and the detected chord type. At the next step 506, the CPU 107 stores the channel number contained in the assigned channel register $ARPASS_i$ into the temporary buffer EVCH. Then, at the step 507, the CPU 107 causes the tone signal generating channel, which is designated by the channel number in the buffer EVCH, to generate the tone signal in accordance with key data contained in the rhythm pattern data read from the table $PTNTBL_i$. The CPU 107 then increments the "i" by one at the step 508, and repeats the above processing until the "i" becomes greater than "4" (step 509).

At step 510, the contents of the tempo counter TCL are incremented by one. Then, it is determined at the next step 511 whether the contents of the counter TCL are smaller than "64". If the contents of the counter TCL are smaller than "64", the interrupt is reset and the control of the CPU 107 is returned to the routine in which this tempo interrupt was occurred. On the other hand, if the contents of the counter TCL are equal to "64", the CPU 107 resets the contents of the tempo counter TCL to ∂0", resets the interrupt, and returns its control to the routine in which this tempo interrupt was occurred.

With the above arrangement, when the playing mode is changed by closing the rhythm switch 105 so that a music accompaniment is automatically played, four tone signal generating channels for an accompaniment chord are selected from (1) the idle tone signal generating channels at the highest priority; (2) those tone signal generating channels, to which the earliest released keys are assigned, at the second highest priority; and (3) those tone signal generating channels, to which the earliest depressed keys are assigned, at the third highest priority. A re-assignment of key is not performed with respect to those tone signal generating channels which have to continue their tone signals to generate. If the idle tone tone signal generating channels then required should not be available and the earliest released key channel and the earliest depressed key channel should be still sounding tones, those tones are truncated to provide tone signal generating channel or channels for the automatic accompaniment tone generation. However, possibility of such an instance is quite low and besides the truncation of the decaying tone and the earliest depressed key tone has only slight influence on the whole tones then generating.

Meanwhile, it may be possible to select the tone signal generating channels for an accompaniment chord from predetermined four of the tone signal generating channels. With this arrangement, however, when the playing mode is changed to the automatic accompaniment playing mode, some of the predetermined four tone signal generating channels may have been assigned keys depressed or released relatively lately and therefore need to continue to generate the corresponding tone signals. In such a case, the aforesaid keys must be re-assigned to tone signal generating channels other than the predetermined four tone signal generating channels, which results in discontinuities of the tones corresponding to the above keys. The above-described embodiment will not suffer from such disadvantage since any re-assignment of keys is not performed.

With the above-described embodiment, if more than four keys are in the depressed state and have been assigned to the tone signal generating channels to produce tones corresponding to the depressed keys, one of the depressed keys which was depressed earliest is truncated to use the channel corresponding to the truncated key as a tone signal generating channel for the accompaniment chord. Such truncation may alternatively be performed from the key whose tone pitch is the highest. This can be accomplished by modifying the steps 405 and 406 of the change-of-assignment processing 400 as shown in FIG. 13.

Figure 13:
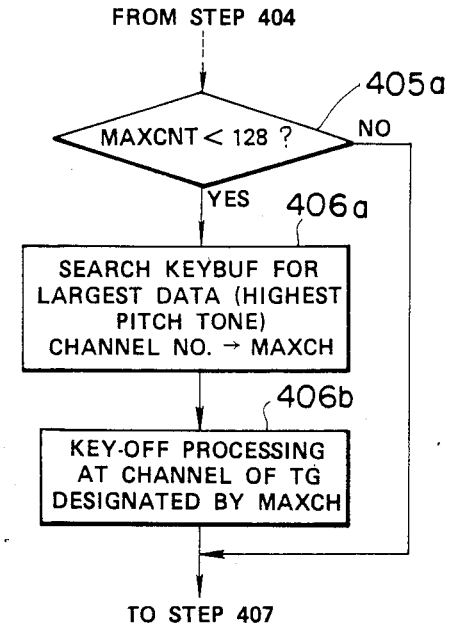
FIG. 13 is a part of the change-of-assignment processing 400 of a modified form of the electronic musical instrument 100 of FIG. 1.

In FIG. 13, it is determined at step 405*a* whether the contents of the buffer MAXCNT are smaller than "128" (or "10000000"). If the contents of the buffer MAXCNT are smaller than "128", the processing proceeds to step 406*a* at which the CPU 107 searches the key buffers $KEYBUF_1$ to $KEYBUF_8$ for the one which contains the largest data, i. e., the key code of the highest pitch. The CPU 107 then stores the number of the tone signal generating channel, which corresponds to the key buffer containing the highest pitch key code, into the temporary buffer MAXCH. At the next step 406*b* the CPU 107 performs a key-off processing with respect to the tone signal generating channel of the tone signal generating circuit 113 designated by the channel number contained in the buffer MAXCH. Then, the processing proceeds to the aforesaid step 407 of the change-of-assignment processing 400 of FIG. 11.

With the above described embodiment, if the number of depressed keys exceeds the maximum number of keys simultaneously assignable to the tone generating channels, the excessively depressed key or keys are ignored. The electronic musical instrument 100 may however be modified so that the key depressed most recently is assigned to the tone signal generating channel at the highest priority. This modification can be achieved by substituting steps 501 to 504 shown in FIG. 14 for the steps 304 to 306 of the key event processing 300 shown in FIG. 10.

Figure 14:
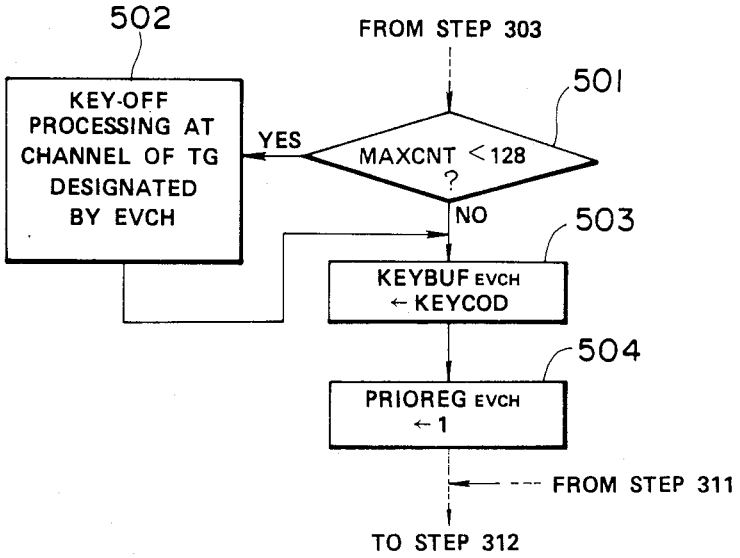
FIG. 14 is a part of the key event processing 300 of a further modified form of the electronic musical instrument 100 of FIG. 1.

In FIG. 14, if it is determined at the step 501 that the contents of the buffer MAXCNT are smaller than "128", the processing proceeds to step 502 at which the CPU 107 performs a key-off processing with respect to the tone signal generating channel designated by the channel number contained in the buffer EVCH. Then, the CPU 107 stores, at the next step 503, the key code contained in the key code buffer KEYCOD into one of the key code buffers KEYBUF designated by the channel number in the buffer EVCH. At the step 504, the CPU 107 stores "1" into the priority register PRIOREG designated by the channel number in the buffer EVCH. Then, the processing returns to the step 312 of the key event processing 300 of FIG. 10.

What is claimed is:

1. An electronic musical instrument having a keyboard and an automatic musical accompaniment playing system for automatically playing a musical accompaniment, said electronic musical instrument comprising:

keyboard circuit means responsive to each depression of key on the keyboard for outputting a key code representative of said depressed key;

tone generating means having a plurality of tone signal generating channels each for generating a tone signal representative of a tone to be generated;

assigning means for assigning said key codes from said keyboard circuit means to said plurality of tone signal generating channels, each of said tone signal generating channels generating the tone signal corresponding to the key whose key code is assigned thereto;

playing mode selection means for selecting one of a plurality of playing modes of the electronic musical instrument which include an automatic playing mode wherein the automatic musical accompaniment system operates; and channel reserving means for reserving a predetermined number of channels among said plurality of tone signal generating channels for use by the automatic musical accompaniment system when said automatic playing mode is selected by said playing mode selection means, said channel reserving means selecting the channels of said predetermined number from among said plurality of channels according to a predetermined priority order which is based on the conditions of tone generation of the respective channels.

2. An electronic musical instrument according to claim 1, wherein said channel reserving means reserving said predetermined number of ones of said plurality of tone signal generating channels when said playing mode of the electronic musical instrument is changed to said automatic playing mode from one of the remaining ones of said plurality of playing modes.

3. An electronic musical instrument according to claim 2 further comprising an auto rhythm system for automatically generating a rhythm tone and a rhythm start/stop switch for starting and stopping the operation of the auto rhythm system, wherein the automatic musical accompaniment playing system operates in synchronism with the auto rhythm system, said channel reserving means reserving said predetermined number of ones of said plurality of tone signal generating channels when said rhythm start/stop switch is closed to start to operate the auto rhythm system.

4. An electronic musical instrument according to claim 2, wherein said channel reserving means selects said predetermined number of tone signal generating channels to be reserved from those tone signal generating channels which are idle at the highest priority, those tone signal generating channels to which the earliest released keys are assigned at the second highest priority, and those tone signal generating channels to which the earliest depressed keys are assigned at the third highest priority.

5. An electronic musical instrument according to claim 2, wherein said channel reserving means selects said predetermined number of tone signal generating channels to be reserved from those tone signal generating channels which are idle at the highest priority, those tone signal generating channels to which the earliest released keys are assigned at the second highest priority, and those tone signal generating channels to which the highest pitch keys among the depressed keys are assigned at the third highest priority.

* * * * *